US008403032B2

(12) United States Patent
Huang et al.

(10) Patent No.: US 8,403,032 B2
(45) Date of Patent: Mar. 26, 2013

(54) STRUCTURE OF HEAT PLATE

(75) Inventors: Yu-Po Huang, Kunshan (CN); Tung-Jung Kuo, Kunshan (CN)

(73) Assignee: Kunshan Jue-Choung Electronics Co., Ltd., Kunshan, Jiangsu (CN)

( * ) Notice: Subject to any disclaimer, the term of this patent is extended or adjusted under 35 U.S.C. 154(b) by 589 days.

(21) Appl. No.: 12/654,776

(22) Filed: Dec. 31, 2009

(65) Prior Publication Data

US 2011/0155350 A1 Jun. 30, 2011

(51) Int. Cl.

| | |
|---|---|
| ***F28F 9/26*** | (2006.01) |
| ***F28F 3/14*** | (2006.01) |
| ***F28F 9/04*** | (2006.01) |
| ***B23P 6/00*** | (2006.01) |

(52) U.S. Cl. ..... 165/104.26; 165/104.33; 165/170; 165/178; 29/890.032

(58) Field of Classification Search ..... 165/104.33, 165/170, 178; 361/700; 29/890.032; 220/724–728
See application file for complete search history.

(56) References Cited

U.S. PATENT DOCUMENTS

| | | | | |
|---|---|---|---|---|
| 2,781,645 | A * | 2/1957 | Simmons | 62/515 |
| 5,709,252 | A * | 1/1998 | Princiotta et al. | 141/18 |
| 6,082,443 | A * | 7/2000 | Yamamoto et al. | 165/104.26 |
| 7,143,511 | B2 * | 12/2006 | Connors et al. | 29/890.032 |
| 7,322,487 | B1 * | 1/2008 | Hill | 220/581 |
| 2003/0066628 | A1 * | 4/2003 | Mochizuki et al. | 165/104.26 |
| 2006/0000588 | A1 * | 1/2006 | Kang et al. | 165/170 |
| 2007/0295486 | A1 * | 12/2007 | Su et al. | 165/104.26 |
| 2008/0035313 | A1 * | 2/2008 | Hsu | 165/104.33 |
| 2008/0047140 | A1 * | 2/2008 | Hsu | 29/890.03 |
| 2008/0222890 | A1 * | 9/2008 | Wang et al. | 29/890.032 |
| 2008/0277107 | A1 * | 11/2008 | Huang | 165/182 |
| 2008/0301943 | A1 * | 12/2008 | Liu | 29/890.032 |
| 2009/0040726 | A1 * | 2/2009 | Hoffman et al. | 361/700 |
| 2012/0080170 | A1 * | 4/2012 | Yang | 165/104.26 |

* cited by examiner

*Primary Examiner* — Allen Flanigan
*Assistant Examiner* — Jason Thompson
(74) *Attorney, Agent, or Firm* — Chun-Ming Shih; HDLS IPR Services

(57) ABSTRACT

A structure of heat plate includes a hollow portion formed adjacent to a side edge of a plate body or in a corner of the plate body. A seal tube is received in the hollow portion so that the plate body provides complete protection to the seal tube against deformation or damage of the seal tube caused by external impact or hit and offers the advantages of simple structure, excellent durability, being easy to practice, and flexibility of arrangement.

1 Claim, 6 Drawing Sheets

STRUCTURE OF HEAT PLATE

FIELD OF THE INVENTION

The present invention relates to a structure of heat plate, and in particular to a structure of heat plate that provides complete protection to a seal tube by a plate body for transferring and dispersing thermal energy generated in the operation of an electronic device.

BACKGROUND OF THE INVENTION

An electronic device often generates and releases thermal energy in the operation thereof. A solution for overcoming such thermal energy is to install a heat plate in order to remove the thermal energy. The heat plate is of the properties of high heat transfer rate, light weight, and simple structure, and provides an advantage of transfer of a great amount of heat without consuming electrical power.

FIG. 1 of the attached drawings shows a perspective view of a conventional structure of heat plate. The conventional heat plate comprises a plate body A, which has an interior hollow space forming a vacuum chamber. The vacuum chamber contains therein a capillary structure and is filled with a working fluid. An edge of the plate body A is connected to a seal tube B (also referred to as opening sealing tube, degassing tube, or filling/degassing tube). The seal tube B has an end connected to the plate body A and is in communication with the vacuum chamber. The seal tube B allows the working fluid to be filled from the outside into the interior space of the heat plate A (namely the vacuum chamber) and to carry out degassing and evacuation operation, whereby heat generated during the operation of an electronic device can be dissipated. However, the conventional seal tube B has an opposite end that projects beyond the heat plate A. Since the seal tube B is arranged in an exposed manner, the seal tube B is susceptible to deformation and damage caused by being impacted or hit during the use of transportation thereof. This often leads to degradation of the performance of the heat plate or even totally malfunctioning of the heat plate.

Thus, the present invention aims to provide a structure of heat plate that protects the seal tube from external impact in order to extend the service life of the heat plate.

SUMMARY OF THE INVENTION

The primary objective of the present invention is to provide a structure of heat plate comprising a plate body that forms a hollow portion and a seal tube that is set in the hollow portion whereby the seal tube is protected from deformation and damage caused by external impact or hit and the efficacies of being a simple structure, durable, and easy to practice can be realized to enhance the practicability, novelty, and improvement of the present invention.

A secondary objective of the present invention is to provide a structure of heat plate comprising a plate body that defines a hollow portion in any one of a plurality of side edges of the plate body or any one of a plurality of corners of the plate body and a seal tube arranged in the hollow portion so as to achieve the efficacy of flexible arrangement and thus enhance the practicability, novelty, and improvement of the present invention.

To realize the above objectives, the present invention provides a structure of heat plate comprising: a plate body and a seal tube. The plate body forms a hollow portion in any one of a plurality of side edges thereof or any one of a plurality of corners thereof. The seal tube is arranged in the hollow portion and has an end in communication with an interior space of the plate body. As such, the structure is simple, durable, and easy to practice and an advantage of flexible arrangement can be realized to thereby provide practicability, novelty, improvement, and convenience.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
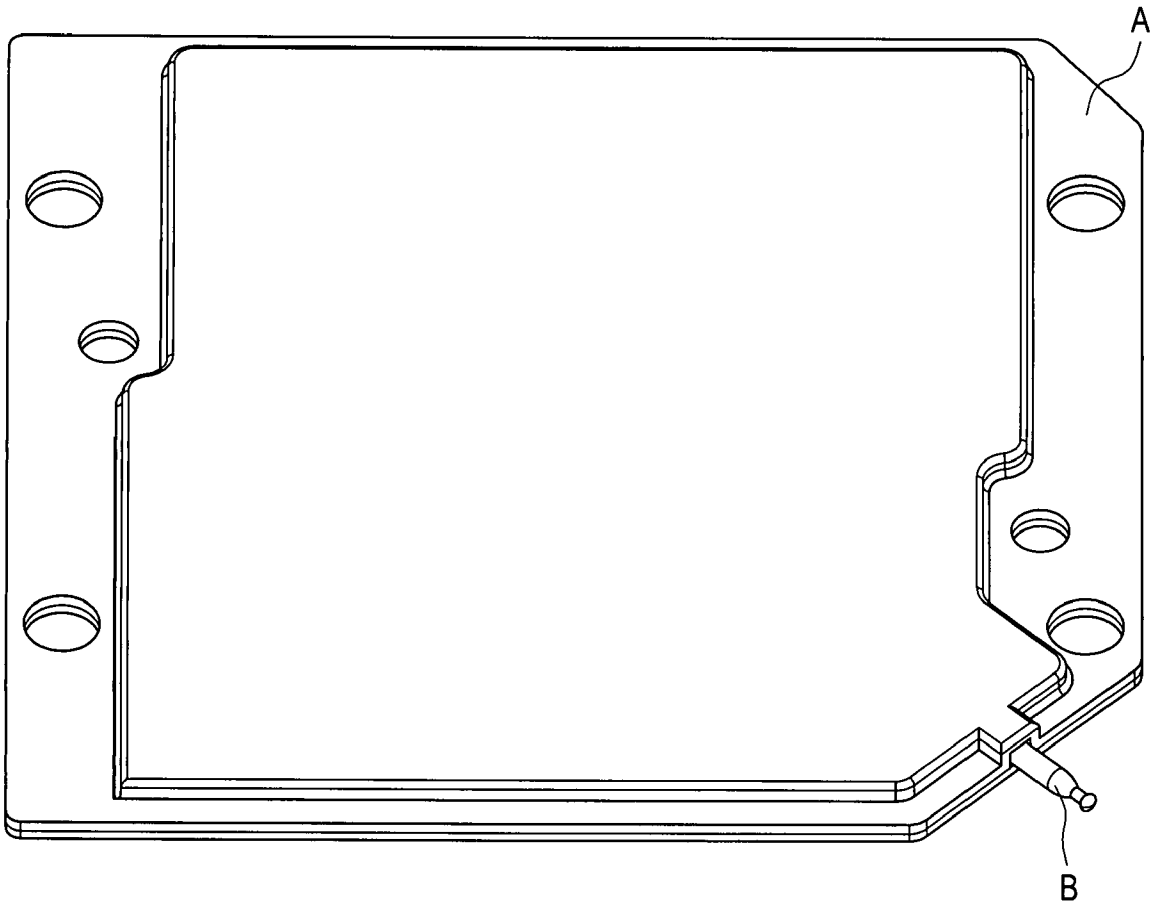
FIG. 1 (PRIOR ART)
FIG. 1 is a perspective view showing a conventional structure of heat plate.
Figure 2:
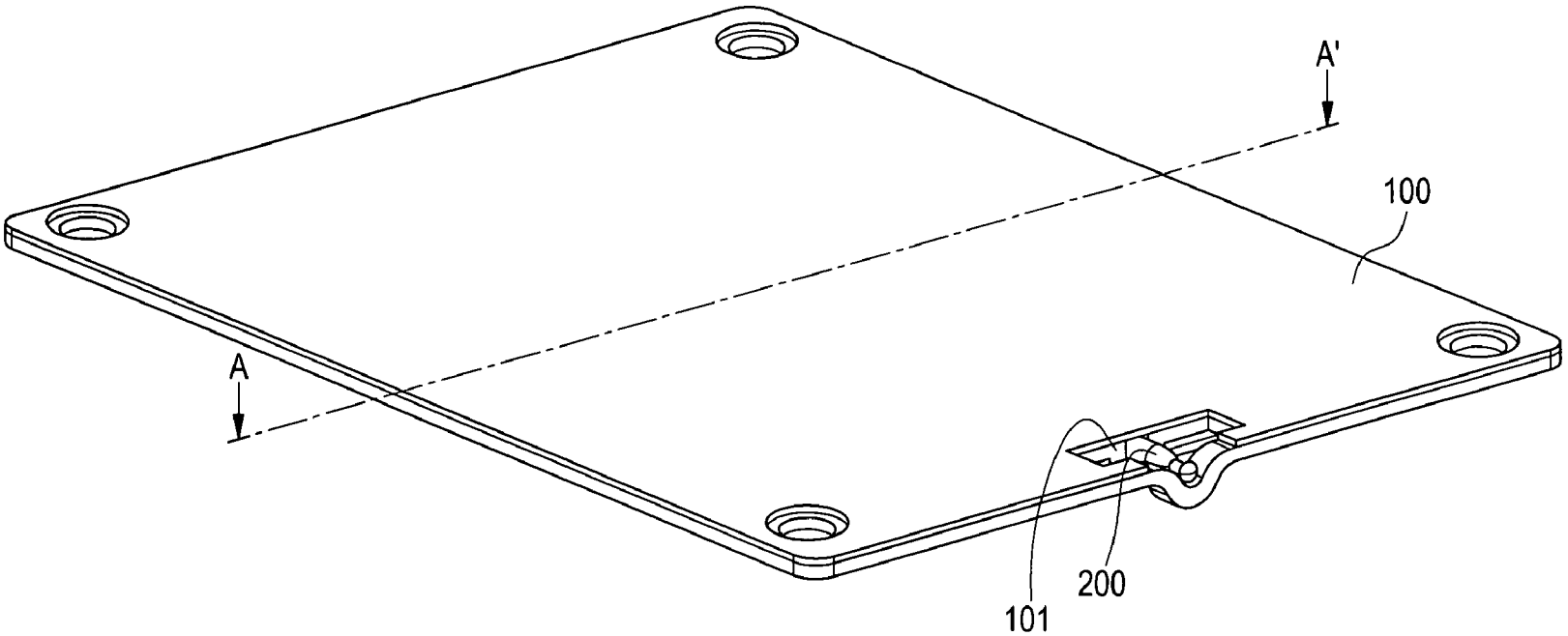
FIG. 2 is a perspective view showing a structure of heat plate in accordance with a first embodiment of the present invention.
Figure 3:
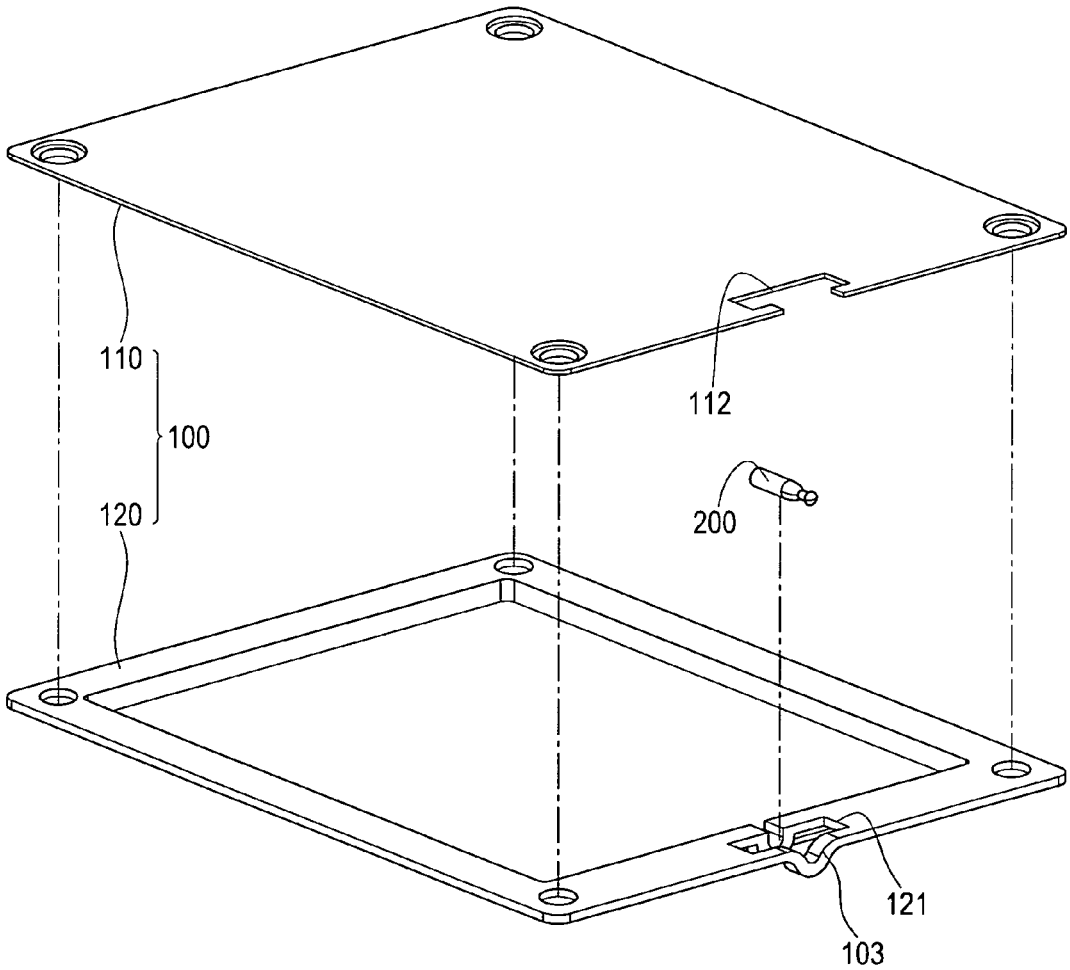
FIG. 3 is an exploded view of the structure of heat plate in accordance with the first embodiment of the present invention.
Figure 4:
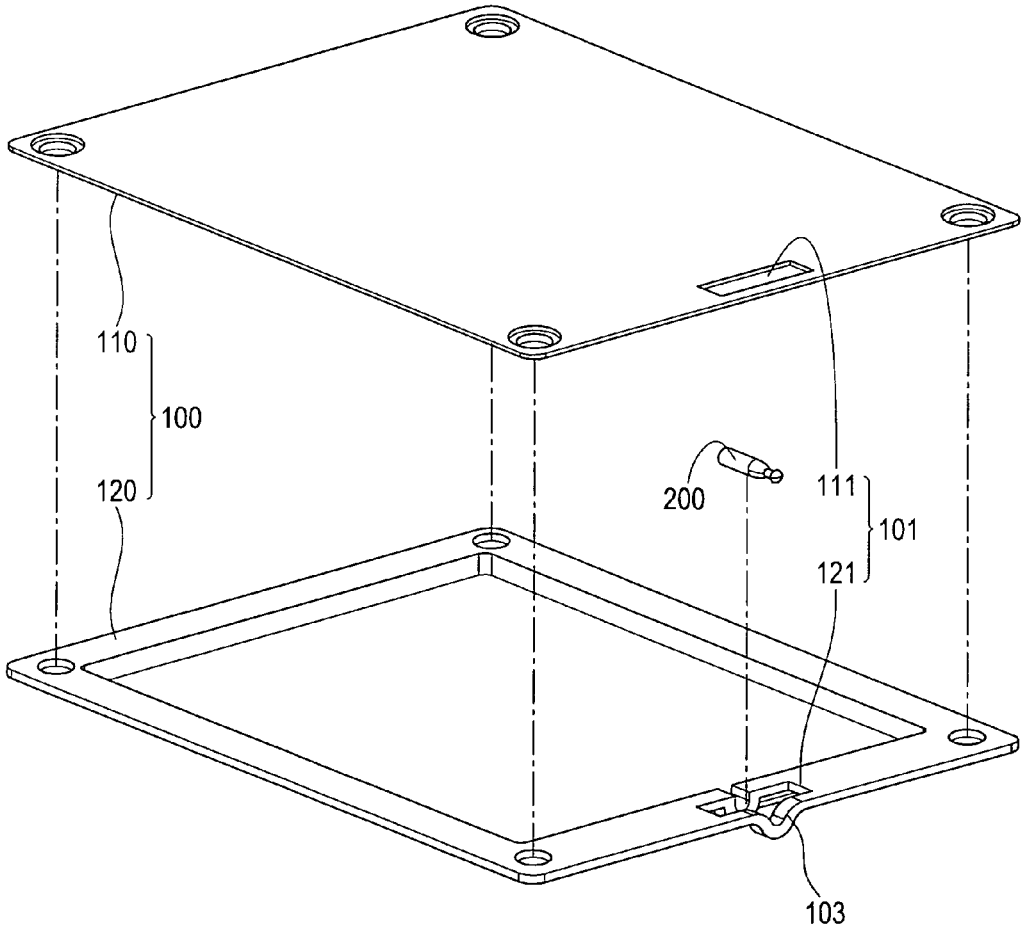
FIG. 4 is an exploded view of the structure of heat plate in accordance with a second embodiment of the present invention.

With reference to the drawings and in particular to FIGS. 2-4, which respectively show a perspective view of a heat plate in accordance with a first embodiment of the present invention, an exploded view of the heat plate of the first embodiment of the present invention, and an exploded view of a heat plate in accordance with a second embodiment of the present invention, the heat plate of the present invention has a structure that comprises a plate body 100 in which a hollow portion 101 is formed. A seal tube 200 is received in the hollow portion 101 and the seal tube 200 functions to fill a working fluid from the outside into an interior space of the plate body 100 and/or to evacuate the interior space in order to realize the effects of reducing the temperature of a heat source and effectively dissipating thermal energy through phase change of the working fluid and circulation of the working fluid through a capillary structure formed inside the plate body 100.

Figure 2A:
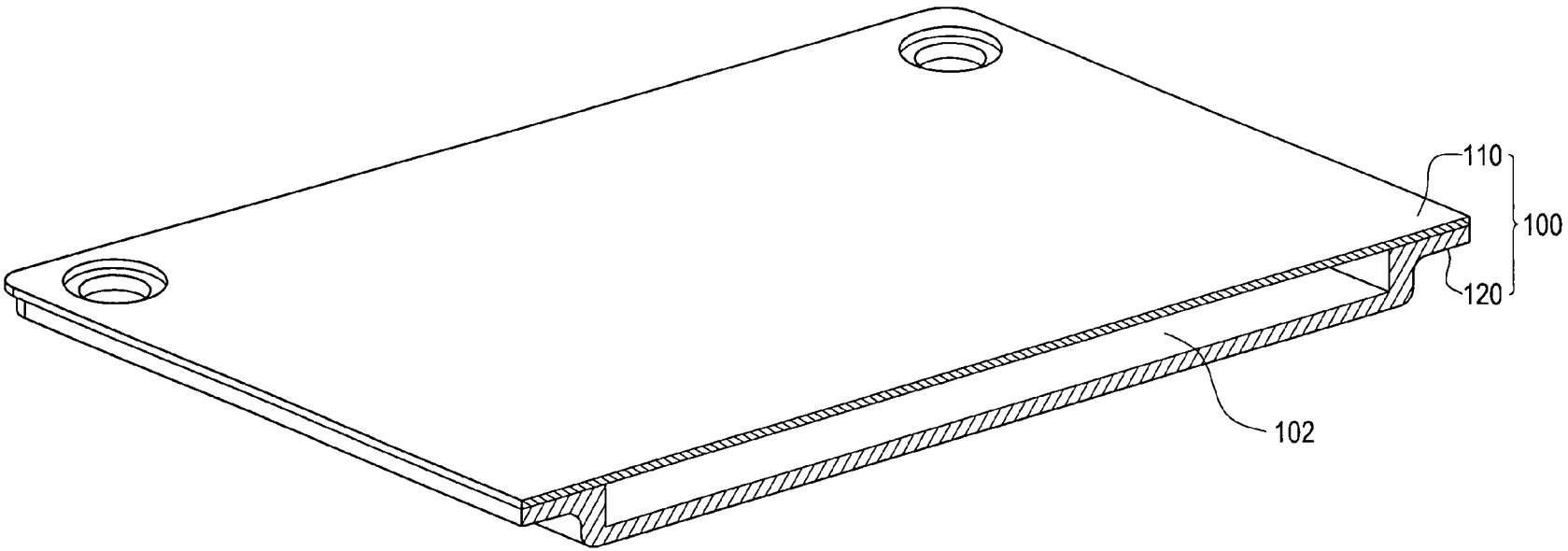
FIG. 2A is a perspective view of the heat plate of the present invention that is cut away along line A-A' of FIG. 2.

The plate body 100 is provided with the hollow portion 101. The plate body 100 comprises a first plate section 110 and a second plate section 120 that oppose, mate, and joint to each other to define a receiving chamber 102 between the first plate section 110 and the second plate section 120. (As shown in FIG. 2A, in the instant embodiment, the second plate 120 forms a recess, which, when the first plate section 110 and the second plate section 120 are jointed to each other, forms the receiving chamber 102, but it is feasible in practical applications to have the first plate section 110 forming a recess, or to have the first plate section 110 and the second plate section 120 both forming a recess, which form the receiving chamber 102 after the first and second plate sections 110, 120 are jointed to each other.) The joint between the first plate section 110 and the second plate section 120 can be realized through blazing with copper paste and silver paste, diffusion bonding, or welding, so that the plate body 100, after being so jointed, forms therein the receiving chamber 102 that is set in a vacuum condition and contains a capillary structure and a working fluid. The first plate section 110 forms a first opening 111, and the second plate section 120 forms a second opening 121, whereby the first opening 111 and the second opening 121 are jointed to each other to form the hollow portion 101 (see FIG. 4). Alternatively, the first plate section 110 may form a notch 112, and the second plate section 120 forms a second opening 121, so that the notch 112 corresponds to and is jointed to the second opening 121 to form the hollow portion 101 (see FIGS. 2 and 3).

The seal tube 200 (which is a hollow tubular member) is received in the hollow portion 101 and the seal tube 200 has an end connected to and in communication with the interior space of the plate body 100. (Namely, the end of the seal tube 200 communicates the receiving chamber 102 of the plate body 100.) A reinforced section 103 is formed between an outer edge of the plate body 100 and the hollow portion 101, so that an opposite end of the seal tube 200 is set on the reinforced section 103 in such a way that the reinforced section 103 provides protection to the seal tube 200 and allows the seal tube 200 to fill a working fluid from the outside into the receiving chamber 102 or to evacuate the receiving chamber 102.

Figure 5:
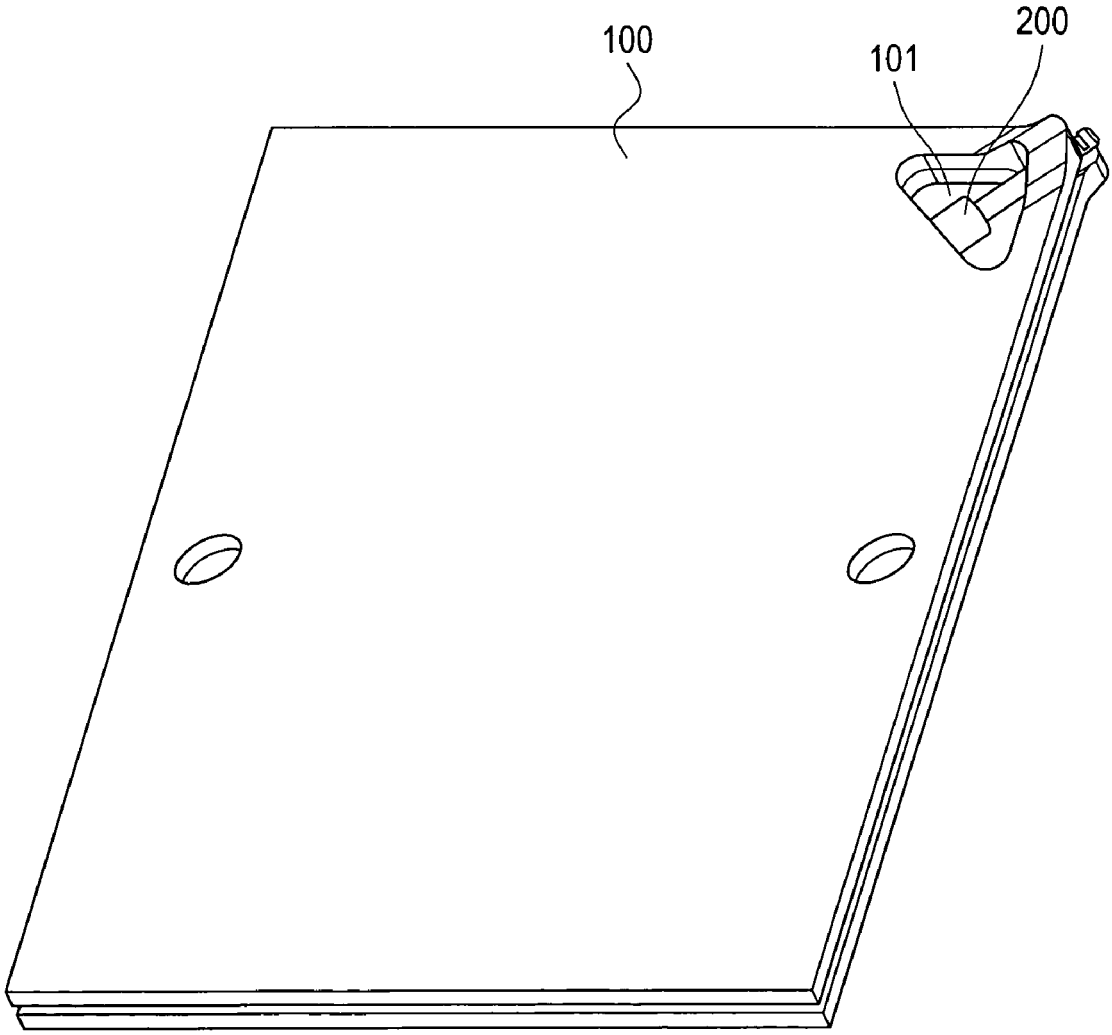
FIG. 5 is a perspective view showing a structure of heat plate in accordance with a third embodiment of the present invention.

In the above described embodiment, the plate body 100 has a plurality of side edges (four side edges) and the hollow portion 101 is formed adjacent to one of the side edges. In a third embodiment of the heat plate of which a perspective view is shown in FIG. 5, the plate body 100 has a plurality of corners (four corners) and the hollow portion 101 is formed in one of the corners with the seal tube 200 received in the hollow portion 101 and an end of the seal tube 200 communicating the interior space of the plate body 100, so as to allow the seal tube 200 to fill a working fluid from the outside into the plate body 100 or carry out evacuation, thereby realizing reduction of the temperature of a heat source and effective dissipation of thermal energy through phase change of the working fluid and circulation of the working fluid through a capillary structure formed inside the plate body 100.

The feature of the structure of heat plate according to the present invention is as follows. With a hollow portion 101 formed in the plate body 100 and a seal tube 200 being received in the hollow portion 101, the seal tube 200 is protected against deformation and damage caused by external impact or hitting and advantages of simple structure, excellent durability, and being easy to practice are obtained to thereby enhance the practicability, novelty, and improvement of the present invention. Further, with the hollow portion 101 of the plate body 100 being formed in any one of a plurality of side edges or any one of a plurality of corners of the plate body 100 and the seal tube 200 being received in the hollow portion 101, an advantage of flexible arrangement can be obtained to enhanced the practicability, novelty, and convenience of the present invention.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A heat plate, comprising:

a plate body including a receiving chamber and a hollow portion;

a seal tube received in the hollow portion, the seal tube having a first end communicating with the receiving chamber;

the plate body further including a first plate section and a second plate section, the plate sections being opposed and joined to each other to define the receiving chamber; and a reinforced section formed between an outer edge of the plate body and the hollow portion, and the seal tube having a second end set on the reinforced section.

* * * * *